US008462966B2

(12) United States Patent
Steffens et al.

(10) Patent No.: US 8,462,966 B2
(45) Date of Patent: Jun. 11, 2013

(54) APPARATUS AND METHOD FOR CALCULATING FILTER COEFFICIENTS FOR A PREDEFINED LOUDSPEAKER ARRANGEMENT

(75) Inventors: Robert Steffens, Niedernissa (DE); Frank Melchior, Erfurt (DE); Martin Dausel, Erfurt (DE); Andreas Graefe, Erfurt (DE)

(73) Assignee: IOSONO GmbH, Erfurt (DE)

( * ) Notice: Subject to any disclaimer, the term of this patent is extended or adjusted under 35 U.S.C. 154(b) by 276 days.

(21) Appl. No.: 12/889,179

(22) Filed: Sep. 23, 2010

(65) Prior Publication Data

US 2011/0135124 A1 Jun. 9, 2011

Related U.S. Application Data

(60) Provisional application No. 61/245,064, filed on Sep. 23, 2009.

(30) Foreign Application Priority Data

Feb. 12, 2010 (EP) ..... 10153467

(51) Int. Cl.
*H04R 5/02* (2006.01)

(52) U.S. Cl.
USPC ..... 381/300; 381/310

(58) Field of Classification Search
USPC ..... 381/300, 17
See application file for complete search history.

(56) References Cited

U.S. PATENT DOCUMENTS

| | | | | |
|---|---|---|---|---|
| 7,394,903 | B2 | 7/2008 | Herre et al. | |
| 7,526,093 | B2 * | 4/2009 | Devantier et al. | 381/59 |
| 8,189,824 | B2 * | 5/2012 | Strauss et al. | 381/300 |
| 2006/0167963 | A1 | 7/2006 | Bruno et al. | |
| 2008/0025534 | A1 * | 1/2008 | Kuhn et al. | 381/300 |
| 2008/0232617 | A1 | 9/2008 | Goodwin et al. | |
| 2009/0123007 | A1 * | 5/2009 | Katayama | 381/300 |

FOREIGN PATENT DOCUMENTS

| | | |
|---|---|---|
| EP | 0756438 | 1/1997 |
| EP | 1637012 | 1/2007 |
| WO | WO2008/043549 | 4/2008 |

OTHER PUBLICATIONS

Berkhout, et al.; "Acoustic control by wave field synthesis"; May 1993, Journal Acoustic Society of America, 96 (5); pp. 2764-2778.

* cited by examiner

*Primary Examiner* — Brian Ensey
*Assistant Examiner* — Norman Yu
(74) *Attorney, Agent, or Firm* — Michael A. Glenn; Glenn Patent Group

(57) ABSTRACT

An apparatus for calculating filter coefficients for a predefined loudspeaker arrangement has a multi-channel renderer. The multi-channel renderer calculates a filter coefficient for each loudspeaker of a virtual loudspeaker arrangement, being different from the predefined loudspeaker arrangement, based on a property (e.g. position or type) of a virtual source of an audio object to be reproduced by the predefined loudspeaker arrangement. Further, the multi-channel renderer determines an adapted filter coefficient for a loudspeaker of the predefined loudspeaker arrangement based on one or more calculated filter coefficients of one or more loudspeakers of the different virtual loudspeaker arrangement.

18 Claims, 9 Drawing Sheets

APPARATUS AND METHOD FOR CALCULATING FILTER COEFFICIENTS FOR A PREDEFINED LOUDSPEAKER ARRANGEMENT

CROSS-REFERENCE TO RELATED APPLICATIONS

This application claims priority from European Patent Application No. 10153467.5, which was filed on Feb. 12, 2010, and from U.S. Patent Application Ser. No. 61/245,064, which was filed on Sep. 23, 2009, which are both incorporated herein by reference in their entirety.

BACKGROUND OF THE INVENTION

The present invention relates to wave-field synthesis systems and particularly to an apparatus and a method for calculating filter coefficients for a predefined loudspeaker arrangement.

There is an increasing demand for new technologies and innovative products in the field of consumer electronics. Here, it is important prerequisite for the success of new multimedia systems to offer optimum functionalities or capabilities, respectively. This is achieved by the usage of digital technologies and particularly computer technology. Examples therefore are applications offering an improved realistic audiovisual impression. In known audio systems, a significant weak point is the quality of the spatial sound reproduction of real but also virtual environments.

Methods for multichannel loudspeaker reproduction of audio signals have been known and standardized for many years. All common techniques have the disadvantage that both the location of the loudspeakers and the position of the listener are already imprinted in the transmission format. If the loudspeakers are positioned in a wrong way with regard to the listener, the audio quality suffers significantly. An optimum sound is only possible in a very small area of the reproduction room, the so-called sweet spot.

An improved natural spatial impression as well as stronger enclosure during audio reproduction can be obtained with the help of new technology. The basics of this technology, the so called wave-field synthesis (WFS) have been researched at the TU Delft and have been presented for the first time in the late 80ies (Berkhout, A. J.; de Vries, D; Vogel, P.: Acoustic control by Wave-field Synthesis. JASA 93, 1993).

The basic idea of WFS is based on the application of the Huygens principle of the wave theory.

Every point captured by a wave is the starting point of an elementary wave, which propagates in a spherical or circular way.

Applied to acoustics, any form of an incoming wave front can be reproduced by a large number of loudspeakers arranged next to another (a so called loudspeaker array). In the simplest case, a single point source to be reproduced and a linear arrangement of the loudspeakers, the audio signals of every loudspeaker have to be fed with a time delay and amplitude scaling such that the emitted sound fields of the individual loudspeakers overlay properly. With several sound sources, the contribution to every loudspeaker is calculated separately for every source and the resulting signals are added. In a virtual space with reflecting walls, the reflections can also be reproduced via the loudspeaker array as additional sources. Thus, the calculation effort depends heavily on the number of sound sources, the reflection characteristics of the recording room and the number of loudspeakers.

The particular advantage of this technique is that a natural spatial sound impression is possible across a large area of the reproduction room. In contrary to the known techniques, direction and distance from the sound sources are reproduced very accurately. To a limited degree, virtual sound sources can even be positioned between the real loudspeaker array and the listener.

The technique of wave-field synthesis can also be used advantageously to add a corresponding spatial audio perception to a visual perception. So far, during production in virtual studios, the focus was on the production of an authentic visual impression of the virtual scene. The acoustic impression matching the image is normally imprinted on the audio signal afterwards by manual operating steps in the so-called post production or is considered to be too expensive and too time-consuming to realize and is thus neglected. This causes normally a discrepancy between individual sense impressions, which causes the designed space, i.e. the designed scene, to be considered as less authentic.

For reproduction of surround sound, corresponding reproduction systems with a series of loudspeakers, which are arranged around the listener, are used. Each loudspeaker receives its own audio signal in a way, so that a spatial scene is established by the super position of the loudspeaker signals. In this process a mapping of the source data (audio and meta data) to the loudspeaker signals is done, wherein the target loudspeaker arrangement is usually known.

If an ideal or optimal arrangement of the loudspeakers is available for the reproduction system, this arrangement should also be used for the real loudspeaker arrangement. However, this is not possible every time, so that an incorrect reproduction may be caused. If the actual arranged loudspeaker setup differs from the ideal arrangement, reproduction errors may appear, which may falsify, for example, a localization of the sound source reproduced by the system.

For the calculation of the audio signals for surround sound mixes, audio signals of virtual sources are mapped to the existing loudspeaker arrangement. In this process the audio signals of the sources are linked with meta data, which influence the calculation (rendering) of the audio signals. Depending on the method, this meta data comprises for example direction information, 2D- or 3D-position information, information about the emission behavior of the source, etc. The calculation algorithm uses information about the arrangement positions of the loudspeakers and meta data of the sources for generating coefficients, which describe the mapping of the source audio data to the resulting loudspeaker signals.

A corresponding algorithm for generating corresponding coefficients is mostly easier to develop for ideal loudspeaker arrangements. However, it may not be possible for real existing loudspeaker arrangements to represent the ideal loudspeaker positions. For example, due to structural reasons, it may not be possible to locate loudspeakers at their ideal positions. Occasionally, it is not possible at all to place parts of the loudspeaker arrangement. So, the real loudspeaker arrangement may differ from its ideal example due to missing loudspeakers and/or loudspeakers shifted in space.

Examples for the calculation of filter coefficients for the reproduction of virtual sources by a loudspeaker arrangement, as used for example in the field of wave-field synthesis, are described in "Berkhout, A. J., de Vries, D., and Vogel, P. (1993). Acoustic control by wave field synthesis. *Journal Acoustic Society of America,* 93(5):2764-2778." and "Röder, T., Sporer, T., and Brix, S. (2007). Wave field synthesis device and method for deriving an array of loudspeakers." However, the corresponding published calculation methods assume that the actual existing loudspeaker arrangement is used for the execution of the algorithm, although this arrangement might not be suitable for calculation since these algorithms do not provide handling for non-ideal loudspeaker placements or gaps in the speaker arrays.

The problem, that for the reproduction actual loudspeaker arrangements differ from an ideal arrangement, is made subject of discussion at various points and solutions are proposed. For example, "Jokinen, R. and Mäkivirta, A. (1997). A method and device for correcting the auditory image in a multichannel audio system" shows a possibility for correcting an incorrect positioned surround loudspeaker arrangement by delaying audio signals or by taking care of a listening position deviating from the system center. In "Goodwin, M. M. and Jot, J.-M. (2008). Multichannel surround format conversion and generalized upmix" the directions for different frequency components within the signal are reconstructed from the output signals for determined loudspeaker positions and distributed to the actual positioned loudspeakers, so that the original direction impression of the sound is kept as good as possible. In "Bruno, R., Laborie, A., and Montoya, S. (2006). Method and device for controlling a reproduction unit using a multi-channel signal" existing audio signals, which should be reproduced from different directions for a reconstruction of a sound field, are distributed to loudspeakers, whose positions are not corresponding to the optimal reproduction conditions. Common to all these examples is that it is assumed that the complete sound mixture exists as starting material, whose signals should have fixed set directions (as for example as position setups for loudspeakers according to the norm "5.1 ITU-R BF 775-1").

Another motivation for reducing the channel number of multi-channel mixtures may be found in the field of coding data formats for a digital transmission. A method for saving transmission bandwidth is described for example in "Herre, J. and Faller, C. (2008). Apparatus and method for constructing a multi-channel output signal or for generating a downmix signal." The channel number is reduced and audio data and meta data are created, which may be used by a decoder to reconstruct the original signal as purely as possible. Such methods need also input data, which represent final mixed loudspeaker signals.

In other publications, non-existing loudspeakers are handled as virtual sources. For example, in "Kuhn, C., Pellegrini, R., Rosenthal, M., and Corteel, E. (2008). Method and system for producing a binaural impression using loudspeakers", initially an audio source is calculated for an arrangement of virtual loudspeakers and its signals in combination with their positions are again assumed as virtual sources and are finally reproduced on an real loudspeaker arrangement. Also in "Strauss, M. and Hörnlein, T. (2008). Device and method for generating a number of loudspeaker signals for a loudspeaker array which defines a reproduction area" an arrangement of loudspeakers of a non-existing surround system is assumed as virtual sound sources of a real existing loudspeaker arrangement, wherein the number of loudspeakers of the virtual system to be simulated is smaller than the number of actual existing loudspeakers. For such simulations of virtual sources, the wave-field synthesis seems to be a suitable reproduction method to approximate the positions of the virtual loudspeakers in a sufficiently exact manner.

Disadvantages of known methods are the high computational efforts for calculating the filter coefficients of the loudspeaker arrangements and/or a poor audio quality of reproduced audio signals.

SUMMARY

According to an embodiment, an apparatus for calculating filter coefficients for a predefined loudspeaker arrangement, the predefined loudspeaker arrangement having a plurality of loudspeakers, may have a multi-channel renderer. The multi-channel renderer is configured to calculate a filter coefficient for each loudspeaker of a virtual loudspeaker arrangement, being different from the predefined loudspeaker arrangement, based on a virtual source position or a type of the virtual source of an audio object to be reproduced by the predefined loudspeaker arrangement. Further, the multi-channel renderer is configured to determine an adapted filter coefficient for a loudspeaker of the predefined loudspeaker arrangement based on one or more calculated filter coefficients of one or more loudspeakers of the different virtual loudspeaker arrangement.

According to another embodiment, a method for calculating filter coefficients for a predefined loudspeaker arrangement, wherein the predefined loudspeaker arrangement has a plurality of loudspeakers, may have the steps of: calculating a filter coefficient for each loudspeaker of a virtual loudspeaker arrangement, being different from the predefined loudspeaker arrangement, based on a property of a virtual source of an audio object to be reproduced by the predefined loudspeaker arrangement; and determining an adapted filter coefficient for a loudspeaker of the predefined loudspeaker arrangement based on one or more calculated filter coefficients of one or more loudspeakers of the different virtual loudspeaker arrangement.

Another embodiment may have a computer program with a program code for performing the above method for calculating filter coefficients, when the computer program runs on a computer or a microcontroller.

Embodiments according to the present invention are based on the central idea that filter coefficients determined for the different virtual loudspeaker arrangement are adapted for the predefined loudspeaker arrangements. Since the different virtual loudspeaker arrangement can be determined, for example, so that the calculation of the filter coefficients is easier than a calculation of filter coefficients for the predefined loudspeaker arrangement directly. In this way, the computational effort for calculating the filter coefficients may be significantly reduced. Further, the audio quality of audio signals reproduced by the predefined loudspeaker arrangement may be improved by adapting the filter coefficients for the virtual loudspeaker arrangement in comparison to loudspeaker arrangements reproducing the audio signals with the filter coefficients calculated for the predefined loudspeaker arrangement directly.

In some embodiments, the apparatus for calculating filter coefficients comprises an arrangement determiner. The arrangement determiner determines a different virtual loudspeaker arrangement based on positions of the loudspeakers of the predefined loudspeaker arrangement.

Some embodiments according to the invention relate to a predefined loudspeaker arrangement comprising gaps. In this example, the different virtual loudspeaker arrangement is determined, so that a gap within the predefined loudspeaker arrangement is filled with at least one additional loudspeaker.

Some further embodiments according to the invention relate to a method for calculating filter coefficients for a predefined loudspeaker arrangement, the predefined loudspeaker arrangement comprising a plurality of loudspeakers. The method comprises determining a different virtual loudspeaker arrangement based on positions of the loudspeaker arrangement of the predefined loudspeaker arrangement. Further, the method comprises calculating a filter coefficient for each loudspeaker of the different virtual loudspeaker arrangement based on properties of a virtual source, e.g. its position or type, of an audio object to be reproduced by the predefined loudspeaker arrangement. Additionally, the method comprises determining an adapted filter coefficient for a loudspeaker of the predefined loudspeaker arrangement based on one or more calculated filter coefficients of one or more loudspeakers of the different virtual loudspeaker arrangement.

BRIEF DESCRIPTION OF THE DRAWINGS

Embodiments according to the invention will be detailed subsequently referring to the appended drawings, in which.

DETAILED DESCRIPTION OF THE INVENTION

Figure 1A:
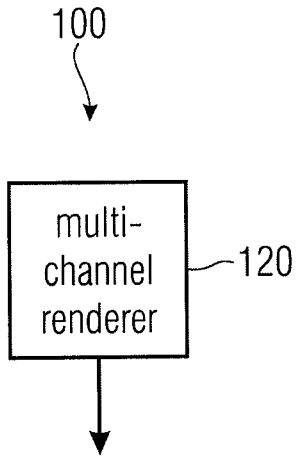
FIG. 1*a*, 1*b* is a block diagram of an apparatus for calculating filter coefficients for a predefined loudspeaker arrangement.

In the following, the same reference numerals are partly used for objects and functional units having the same or similar functional properties and the description thereof with regard to a figure shall apply also to other figures in order to reduce redundancy in the description of the embodiments.

FIG. 1 a shows a block diagram of an apparatus 100 for calculating filter coefficients for a predefined loudspeaker arrangement according to an embodiment of the invention, wherein the predefined loudspeaker arrangement comprises a plurality of loudspeakers. The apparatus 100 comprises a multi-channel renderer 120. The multi-channel renderer 120 calculates a filter coefficient for each loudspeaker of a virtual loudspeaker arrangement, being different from the predefined loudspeaker arrangement, based on properties of a virtual source of an audio object to be reproduced by the predefined loudspeaker arrangement. Further, the multi-channel renderer 120 determines an adapted filter coefficient for a loudspeaker of the predefined loudspeaker arrangement based on the calculated filter coefficient of a loudspeaker of the different virtual loudspeaker arrangement.

A different virtual loudspeaker arrangement may comprise one or more additional loudspeakers in comparison to the predefined loudspeaker arrangement, may comprise one or more removed or missing loudspeakers in comparison to the predefined loudspeaker arrangement and/or may comprise one or more loudspeakers associated to loudspeakers of the predefined loudspeaker arrangement, wherein an associated loudspeaker of the predefined loudspeaker arrangement comprises a different position in comparison to the positions of the associated loudspeakers.

In other words, the different virtual loudspeaker arrangement may be determined by adding one or more loudspeakers to the predefined loudspeaker arrangement, removing one or more loudspeakers from the predefined loudspeaker arrangement and/or relocating one or more loudspeakers of the predefined loudspeaker arrangement.

The different virtual loudspeaker arrangement may be determined, so that the filter coefficients for the loudspeakers of the different virtual loudspeaker arrangement may be calculated with less computational effort than calculating filter coefficients for the predefined loudspeaker arrangement directly. In general, it is often easier to find an algorithm which is correctly working for a different virtual or ideal arrangement (eg. without any gaps involved). Eventually, an algorithm hasn't been found yet addressing the geometry of the predefined loudspeaker setup. This is a reason to use an ideal/virtual loudspeaker setup instead of calculating the coefficients directly for the predefined loudspeakers. For example, a determined different virtual loudspeaker arrangement may comprise a higher geometric symmetry of positions of loudspeakers than a geometric symmetry of the positions of the loudspeakers of the predefined loudspeaker arrangement and/or may comprise a more systematic distribution of the positions of the loudspeakers than the distribution of the positions of the loudspeakers of the predefined loudspeaker arrangement. For example, the different virtual loudspeaker arrangements may be a one dimensional line array, arranged as a square, a rectangle or a circle, or a two dimensional array (e.g. two or more line arrays arranged above each other), also arranged as a square, a rectangle or a circle, with an arrangement similar to the predefined loudspeaker arrangement, wherein the predefined loudspeaker arrangement has some additional, missing and/or dislocated loudspeakers in comparison with the different virtual loudspeaker arrangement. So, the multi-channel renderer 120 may calculate the filter coefficients for the loudspeakers of the different virtual loudspeaker arrangement with low computational effort and adapt one or more of these filter coefficients for one or more loudspeakers of the predefined loudspeaker arrangement. In this connection, the different virtual loudspeaker arrangement may also be called ideal loudspeaker arrangement (in comparison to the predefined loudspeaker arrangement). By reducing the efforts for calculating the filter coefficients, the multi-channel renderer 120 may calculate the filter coefficients faster and/or the hardware requirements for the multi-channel renderer 120 may be reduced. Further, the audio quality of reproduced audio objects may be improved since a difference between an ideal loudspeaker arrangement and a predefined loudspeaker arrangement may be taken into account by adapting filter coefficients determined for the ideal loudspeaker arrangement or an artifact reduced calculation may get possible at all.

A loudspeaker arrangement may be represented by the positions of the loudspeakers of the loudspeaker arrangement. Additionally the orientation of the loudspeakers may be taken into account. The predefined loudspeaker arrangement may represent a real existing loudspeaker arrangement or a loudspeaker arrangement to be realized in a given environment (for example a given geometry of a room). The different virtual loudspeaker arrangement may be a virtually generated loudspeaker arrangement different from the predefined loudspeaker arrangement, wherein the difference may be one or more added loudspeakers, one or more removed loudspeakers and/or one or more dislocated loudspeakers.

Figure 1B:
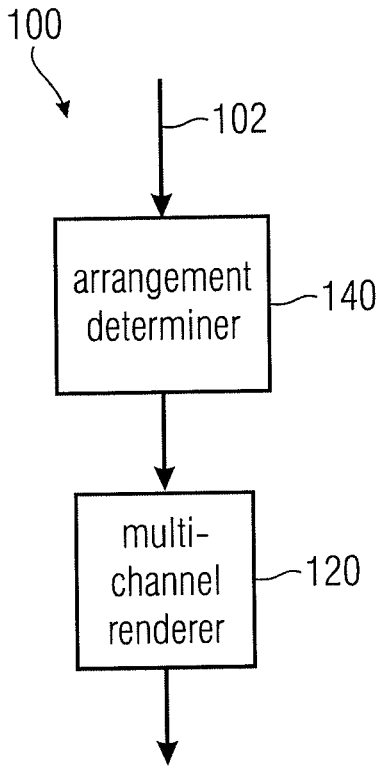

The different virtual loudspeaker arrangement may be given or may be determined by an arrangement determiner as shown in FIG. 1*b*. The arrangement determiner 140 may be connected to the multi-channel renderer 120 and may determine a different virtual loudspeaker arrangement based on positions 102 of the loudspeakers of the predefined loudspeaker arrangement.

Since the different virtual loudspeaker arrangement should be similar to the predefined loudspeaker arrangement, the arrangement determiner 140 may determine the different virtual loudspeaker arrangement, so that more than half (or more than 10%, more than 25%, more than 75% or more than 90%) of the loudspeakers of the different virtual loudspeaker arrangement correspond to the loudspeakers of the predefined loudspeaker arrangement. In this connection a loudspeaker of the different virtual loudspeaker arrangement corresponds to a loudspeaker of the predefined loudspeaker arrangement, if both loudspeakers comprise the same absolute position or the same relative position regarding other loudspeakers of the arrangements. In other words, the different virtual loudspeaker arrangement may be determined, so that many loudspeakers of the different virtual loudspeaker arrangement comprise a same position as the loudspeakers of the predefined loudspeaker arrangement.

Alternatively it may also be possible to create a virtual setup where no loudspeaker has the same attributes as one of the predefined loudspeakers. But there may still be the possibility to map the virtual speakers to the predefined speakers.

A filter coefficient of the loudspeaker may be a scaling parameter or a delay parameter of an audio signal or an audio object to be reproduced by the predefined loudspeaker arrangement. For example, the multi-channel renderer 120 may calculate more than one filter coefficient for each loudspeaker. For example, a scaling parameter is calculated as a first filter coefficient and a delay parameter is calculated as a second filter coefficient for each loudspeaker of the different virtual loudspeaker arrangement. The scaling parameter may also be called amplitude parameter.

A filter coefficient adapted for a loudspeaker of the predefined loudspeaker arrangement may be based on one or more calculated filter coefficients of one or more loudspeakers of the different virtual loudspeaker arrangement. Alternatively, a filter coefficient determined for a loudspeaker of the predefined loudspeaker arrangement may be equal to a filter coefficient calculated for a corresponding loudspeaker of the different virtual loudspeaker arrangement.

An audio object may represent an audio source as for example a car, a train, a raindrop or a speaking person, wherein the virtual source position of an audio object may be for example an absolute position or a relative position in relation to the loudspeaker arrangement. An audio object may be assumed to be a point source emitting spherical waves located at the virtual source position. For audio objects located far away from the loudspeaker arrangement, the spherical wave may be approximated by a plane wave. For a plane wave, the exact virtual source position is irrelevant. Therefore, it may be sufficient to define an audio object by its virtual source type (e.g. a plane wave by the virtual source type and the direction).

The multi-channel renderer 120 may calculate at least one filter coefficient for each loudspeaker of the different virtual loudspeaker arrangement based on properties of a virtual source of an audio object for each audio object of a plurality of audio objects to be reproduced by the predefined loudspeaker arrangement. In other words, at least one filter coefficient may be calculated for each audio object of a plurality of audio objects and for each loudspeaker of the different virtual loudspeaker arrangement.

The arrangement determiner 140 and/or the multi-channel renderer 120 may be independent hardware units, part of the processor, a computer or a microcontroller or a computer program or a computer program product configured to run on a computer or a microcontroller.

The multi-channel renderer 120 may be, for example, a wave-field synthesis renderer or a surround sound renderer. The following examples are explained in terms of a wave-field synthesis renderer, but using other multi-channel renderers for other applications may also be possible. The described concept is the same.

Figure 2:
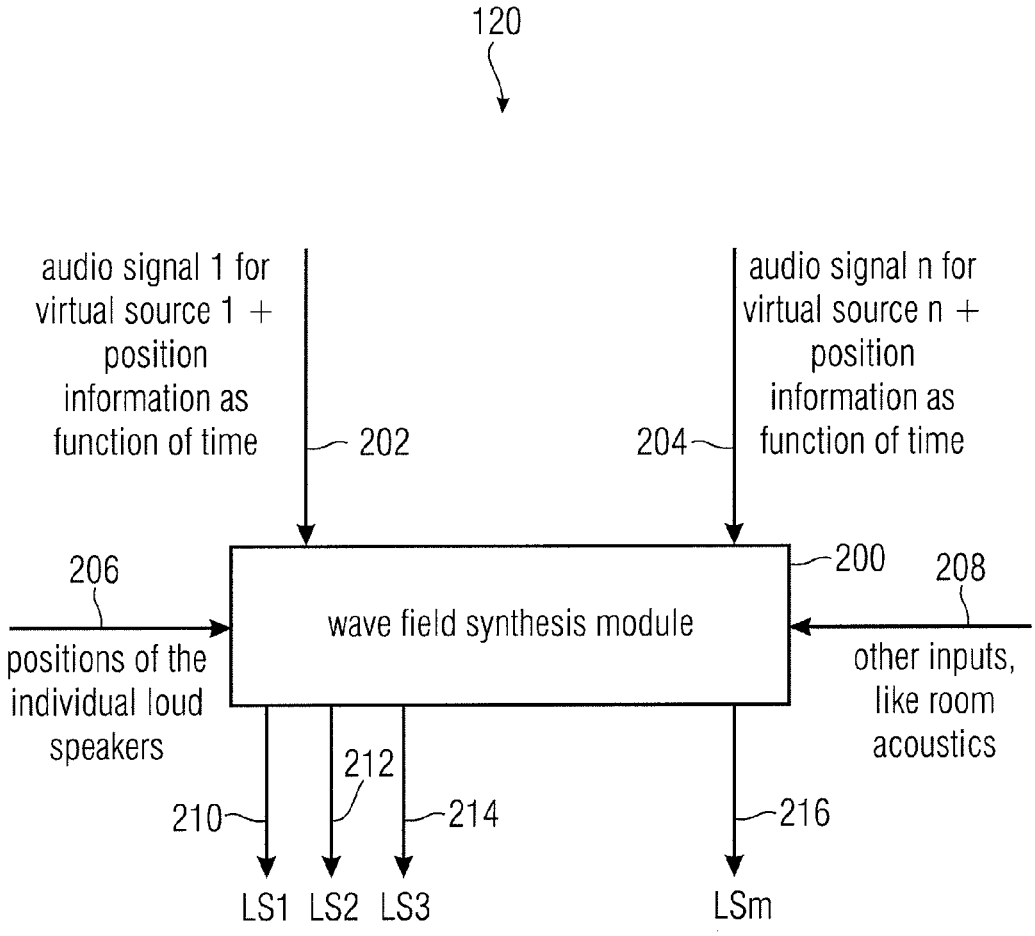
FIG. 2 is a basic diagram of a wave-field synthesis environment as it can be used for the present invention.

As an example for a multichannel renderer a wave-field synthesis renderer (also called wave-field synthesis module) is shown in FIG. 2. A wave-field synthesis module 120 comprising several inputs 202, 204, 206 and 208 as well as several outputs 210, 212, 214 and 216 is the center of a wave-field synthesis environment. Different audio signals for virtual sources are supplied to the wave-field synthesis module via inputs 202 to 204. Thus, input 202 receives, for example, an audio signal of the virtual source 1 as well as associated position information of the virtual source. In a cinema setting, for example, the audio signal 1 would be, for example, the speech of an actor moving from a left side of the screen to a right side of the screen and possibly additionally away from the audience or towards the audience. Then, the audio signal 1 would be the actual speech of the actor, while the position information as function of time represents the current position of the first actor in the scene at a certain time. In contrary, the audio signal n would be the speech, for example of a further actor which moves in the same way or in a different way than the first actor. The current position of the other actor to which the audio signal n is associated, is provided to the wave-field synthesis module 120 by position information synchronized with the audio signal n. In practice, different virtual sources exist, depending on the scene describing their attributes, wherein the audio signal of every virtual source is supplied as individual audio track to the wave-field synthesis module 120.

One wave-field synthesis module feeds a plurality of loudspeakers LS1, LS2, LS3, LSm of the predefined loudspeaker arrangement by outputting loudspeaker signals via the outputs 210 to 216 to the individual loudspeakers. Via the input 206, the positions of the loudspeakers of the different virtual loudspeaker arrangement and the positions of the loudspeakers of the predefined loudspeaker arrangement are provided to the wave-field synthesis module 120.

Alternatively, the filter coefficient calculation and the rendering of audio may be done separately. The renderer would get source and loudspeaker positions and would output filter parameters. After that, the adaptation of the filter coefficients would take place and in a last step, the filter coefficients can be applied to generate the audio. By this, the renderer may be a black box using any algorithm (not only wave-field synthesis) to calculate the filters.

In the cinema, many individual loudspeakers are grouped around the audience, which may be arranged in arrays such that loudspeakers are both in front of the audience, which means, for example, behind the screen, and behind the audience as well as on the right hand side and left hand side of the audience. Further, other inputs can be provided to the wave-field synthesis module 120, such as information about the room acoustics, etc., in order to be able to simulate actual room acoustics during the recording setting in a cinema.

Generally, the loudspeaker signal, which is, for example, supplied to the loudspeaker LS1 via the output 210, will be a superposition of component signals of the virtual sources, in that the loudspeaker signal comprises for the loudspeaker LS1 a first component coming from the virtual source 1, a second component coming from the virtual source 2 as well as an n-th component coming from the virtual source n. The individual component signals may be linearly superposed, which means added after their calculation to reproduce the linear superposition at the ear of the listener who will hear a linear superposition of the sound sources he can perceive in a real setting.

In the following, an example for a detailed design of the wave-field synthesis module 120 will be illustrated with regard to FIG. 3. The wave-field synthesis module 120 may have a very parallel structure in that starting from the audio signal for every virtual source and starting from the position information for the corresponding virtual source, first, delay information $V_i$ as well as scaling factors $SF_i$ (filter coefficients) are calculated for the loudspeakers of the different virtual loudspeaker arrangement, which depend on the position information and the position of the just considered loudspeaker. The calculation of delay information $V_i$ as well as a scaling factor $SF_i$ based on the position information of a virtual source and position of the considered loudspeaker may be performed by known algorithms, which are implemented in means 300, 302, 304, 306. After calculating filter coefficients for the loudspeakers of the different virtual loudspeaker arrangement, one or more filter coefficients are adapted depending on the differences between the loudspeaker arrangements (added, removed or dislocated loudspeakers) by an adapting means 308 to obtain filter coefficients of loudspeakers of the predefined loudspeaker arrangement. The adapting unit 308 may be implemented as single unit (as shown in FIG. 3) or as a plurality of independent units, one for each means 300, 302, 304 and 306.

Based on the delay information $V_i(t)$ and scaling information $SF_i(t)$ of a loudspeaker of the predefined loudspeaker arrangement as well as based on the audio signal $AS_i(t)$ associated to the individual virtual source, a discrete value $AW_i(t_a)$ is calculated for the component signal for a current time $t_a$ in a finally obtained loudspeaker signal. This is performed by means 310, 312, 314, 316 as illustrated schematically in FIG. 3. The individual component signals are then summed by a summer 320 to determine the discrete value for the current time $t_a$ of the loudspeaker signal for a loudspeaker of the predefined loudspeaker arrangement, which can be supplied to an output for the loudspeaker (for example the output 210, 212, 214 or 216 in FIG. 2).

Figure 3:
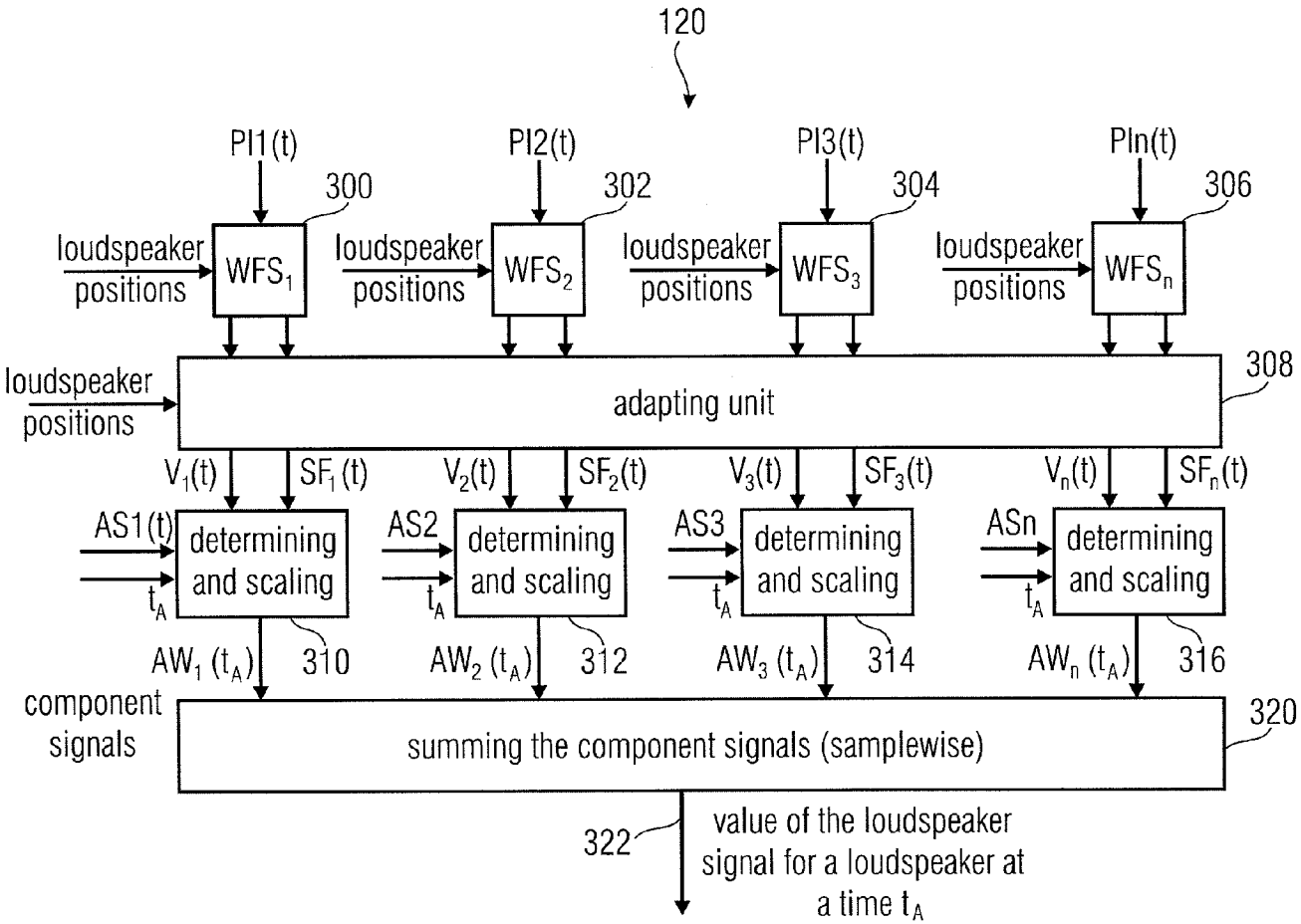
FIG. 3 is a detailed representation of the wave-field synthesis module shown in FIG. 2.

As can be seen from FIG. 3, first, a value $AW_i$ of a loudspeaker of the predefined loudspeaker arrangement is calculated individually for every virtual source, which is valid at a current time due to a delay and scaling with a scaling factor, and then all component signals for one loudspeaker are summed due to the different virtual sources. If, for example, only one virtual source is present, the summer may be omitted and the signal applied at the output of the summer in FIG. 3 would, for example, correspond to the signal output by means 310 when the virtual source 1 is the only virtual source.

Since the different virtual loudspeaker arrangement may be similar to the predefined loudspeaker arrangement it may be unnecessary to adapt filter coefficients for each loudspeaker of the predefined loudspeaker arrangement. For example, for corresponding loudspeakers and especially for corresponding loudspeakers located in a region of the predefined loudspeaker arrangement comprising an equal arrangement of loudspeakers as the different virtual loudspeaker arrangement, the filter coefficients of the loudspeakers of the predefined loudspeaker arrangement may be equal to the calculated filter coefficients of the corresponding loudspeakers of the different virtual loudspeaker arrangement. In other words, the wave-field synthesis renderer 120 may assign a filter coefficient calculated for a loudspeaker of the different virtual loudspeaker arrangement to a corresponding loudspeaker of the predefined loudspeaker arrangement, so that the filter coefficient of at least one loudspeaker of the predefined loudspeaker arrangement is equal to the calculated filter coefficient of the corresponding loudspeaker of the different virtual loudspeaker arrangement.

A loudspeaker of the predefined loudspeaker arrangement comprising no corresponding loudspeaker or a loudspeaker of the different virtual loudspeaker arrangement comprising no corresponding loudspeaker has a stronger influence to neighboring loudspeakers than to loudspeakers faraway. In other words, filter coefficients of loudspeakers neighboring positions at which the predetermined loudspeaker arrangement and the different virtual loudspeaker arrangement differ from each other may be stronger adapted regarding the same audio objects than filter coefficients of loudspeakers far away from such positions. For this, for example, the wave-field synthesis renderer 120 determines an adapted filter coefficient for loudspeakers of the predefined loudspeaker arrangement comprising corresponding loudspeakers within the different virtual loudspeaker arrangement, so that an adapted filter coefficient determined for the loudspeaker of the predefined loudspeaker arrangement comprising a first distance to a loudspeaker comprising no corresponding loudspeaker differs more from a filter coefficient of its corresponding loudspeaker than an adapted filter coefficient determined for a loudspeaker of the predefined loudspeaker arrangement comprising a second distance to the loudspeaker comprising no corresponding loudspeaker. The second distance is larger than the first distance. The adapted filter coefficient determined for the loudspeaker comprising the second distance may also be equal to the filter coefficient of the corresponding loudspeaker.

In some embodiments, the wave-field synthesis renderer 120 may determine an adapted filter coefficient for a loudspeaker of the predefined loudspeaker arrangement, for example, if the loudspeaker of the predefined loudspeaker arrangement comprises an associated loudspeaker within the different virtual loudspeaker arrangement. In this connection, an associated loudspeaker of the different virtual loudspeaker arrangement comprises a different position than the loudspeaker of the predefined loudspeaker arrangement. In other words, associated loudspeakers may be corresponding loudspeakers with different positions. For example, the positions differ within a predefined limit, so that the loudspeakers can be assigned to each other.

In this example, the wave-field synthesis renderer 120 may determine the adapted filter coefficient for the loudspeaker of the predefined loudspeaker arrangement based on a filter coefficient calculated for the associated loudspeaker of the different virtual loudspeaker arrangement. Additionally, the adapted filter coefficient for the loudspeaker of the predefined loudspeaker arrangement may be determined based on a position difference between a position of the loudspeaker of the predefined loudspeaker arrangement and a position of the associated loudspeaker of the different virtual loudspeaker arrangement.

In another example, the wave-field synthesis renderer 120 may determine an adapted filter coefficient for a loudspeaker of the predefined loudspeaker arrangement if the loudspeaker of the predefined loudspeaker arrangement comprises a closest position to a position of an added loudspeaker of the different virtual loudspeaker arrangement of all loudspeakers of the predefined loudspeaker arrangement. Since loudspeakers of a loudspeaker arrangement are often equally spaced from each other, more than one loudspeaker may comprise a closest position. For example, in FIG. 4*a* loudspeaker $L_1$ and $L_5$ comprise the closest position to the added loudspeaker $L_3$. In this connection, an added loudspeaker of the different virtual loudspeaker arrangement comprises no corresponding and no associated loudspeaker within the predefined loudspeaker arrangement. This may be caused by adding a loudspeaker to the different virtual loudspeaker arrangement during determining the different virtual loudspeaker arrangement. Therefore, such a loudspeaker may be called added loudspeaker.

In this example, the wave-field synthesis renderer 120 may determine the adapted filter coefficient for the loudspeaker of the predefined loudspeaker arrangement based on a filter coefficient calculated for the added loudspeaker of the different virtual loudspeaker arrangement. Additionally, the adapted filter coefficient for the loudspeaker of the predefined loudspeaker arrangement may be determined based on a position difference between a position of the loudspeaker of the predefined loudspeaker arrangement and the position of the added loudspeaker of the different virtual loudspeaker arrangement.

Alternatively or additionally, the wave-field synthesis 120 renderer may determine an adapted filter coefficient for a loudspeaker of the predefined loudspeaker arrangement, if the loudspeaker of the predefined loudspeaker arrangement comprises no corresponding and no associated loudspeaker within the different virtual loudspeaker arrangement. In other words, an adapted filter coefficient may be determined for a loudspeaker of the predefined loudspeaker arrangement removed during determining the different virtual loudspeaker arrangement.

In this example, the wave-field synthesis renderer 120 may determine the adapted filter coefficient for the loudspeaker of the predefined loudspeaker arrangement based on a filter coefficient calculated for a loudspeaker of the different virtual loudspeaker arrangement comprising a closest position to a position of the loudspeaker of the predefined loudspeaker arrangement of all loudspeakers of the different virtual loudspeaker arrangement. Additionally, the adapted filter coefficient for the loudspeaker of the predefined loudspeaker arrangement may be determined based on the position difference between the position of the loudspeaker of the predefined loudspeaker arrangement and the loudspeaker of the different virtual loudspeaker arrangement comprising the closest position. Again, more than one loudspeaker may comprise the closest position.

Figure 4A:
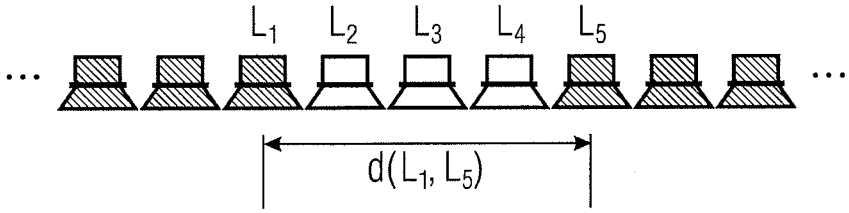
FIG. 4*a* is a schematic illustration of an example for adding loudspeakers to fill a gap within a predefined loudspeaker arrangement.

FIG. 4*a* shows an example for a part of a determined different virtual loudspeaker arrangement, wherein the loudspeakers L2, L3 and L4 of the different virtual loudspeaker arrangement are added between the loudspeakers L1 and L5 of the predefined loudspeaker arrangement. The gray colored loudspeakers (all shown loudspeakers except loudspeaker L2, L3 and L4) are part of the predefined loudspeaker arrangement, while the dark colored and the white loudspeakers (all shown loudspeakers) are part of the different virtual loudspeaker arrangement. The added loudspeakers L2, L3 and L4 are filling the gap between the loudspeakers L1 and L5 of the predefined loudspeaker arrangement, which are separated by a distance indicated with $d(L_1,L_5)$.

Figure 4B:
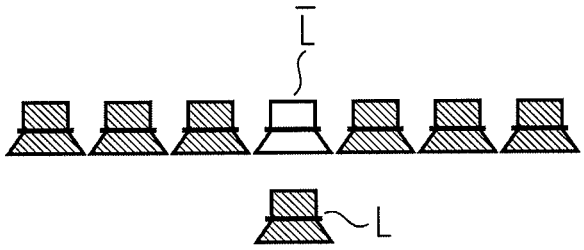
FIG. 4*b* is a schematic illustration of an example of a loudspeaker of a different virtual loudspeaker arrangement associated with a loudspeaker of a predefined loudspeaker arrangement.

FIG. 4*b* shows an example for a dislocated loudspeaker L within the predefined loudspeaker arrangement and a determined different virtual loudspeaker arrangement comprising an associated loudspeaker $\overline{L}$. The dark colored loudspeakers (all shown loudspeakers except loudspeaker $\overline{L}$) are part of the predefined loudspeaker arrangement and all shown loudspeakers except loudspeaker L are part of the different virtual loudspeaker arrangement.

Figure 4C:
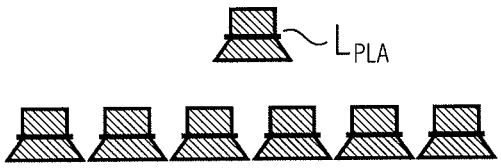
FIG. 4*c* is a schematic illustration of a predefined loudspeaker arrangement comprising a loudspeaker not included in the determined different virtual loudspeaker arrangements.

FIG. 4*c* shows an example for a predefined loudspeaker arrangement comprising a loudspeaker $L_{pla}$, which is not part of the different virtual loudspeaker arrangement. In this case, the different virtual loudspeaker arrangement comprises all shown loudspeakers with exception of loudspeaker $L_{pla}$, while the predefined loudspeaker arrangement comprises all shown loudspeakers.

In some embodiments according to the invention a gap within a loudspeaker arrangement for wave-field synthesis systems is filled by adding one or more loudspeakers, as shown for example in FIG. 4*a*. The idea of a two step coefficient calculation, during which a filter coefficient is calculated for an ideal loudspeaker setup (different virtual loudspeaker arrangement) to derive the filter coefficients for the real loudspeaker setup (predefined loudspeaker arrangement) from it afterwards, is illustrated in the following by an example for an algorithm for the handling of gaps within loudspeaker arrangements for wave-field synthesis systems.

For wave-field synthesis, tightly arranged loudspeakers with individual scaling coefficients and delay coefficients are driven, so that wave fronts of virtual sources, which can be positioned inside or outside a room, may be generated. This happens by the superposition of the individual audio signals of the contributing loudspeakers. The room should be equipped with an as much as possible uninterrupted line of tightly arranged loudspeakers, so that the synthesis of the wave-fields works satisfyingly for all conceivable source positions. If there are gaps within the loudspeaker lines (loudspeaker arrangement), the wave-field synthesis algorithm does not work anymore (or does not work satisfyingly) for those positions, for which the non-existing loudspeakers provide a significant contribution to the generation of the wave-field.

A wave-field synthesis algorithm calculates filters, for example, in terms of amplitude coefficients and delay coefficients for each combination of virtual sound sources and loudspeakers. This calculation may happen separately for each loudspeaker, independent of the loudspeakers in its surrounding. However, if loudspeakers are removed from an uninterrupted, ideal loudspeaker array, the remaining loudspeakers continue playing unchanged. The consequence is that a source in the region of the gap would have to distribute its main energy to the non-existing loudspeakers, but this missing energy is not compensated by the neighboring loudspeakers due to the independent coefficient calculation.

Therefore, two unintended effects appear: a wrong amplitude distribution over the existing loudspeakers and a discontinuity in the temporal course of the delay coefficient value depending on the size of the array gap, if a source crosses the border between inside and outside.

Since gaps in loudspeaker arrays may not be avoidable (often due to structural reasons) in reality a consideration of the missing loudspeakers should be implemented to the calculation of the loudspeaker coefficients, which is done by the proposed concept.

Effects occurring at gaps within a loudspeaker array may be reduced by using the described concept. In this way, an alternative calculation method for the coefficients may be used for source positions in the region of the gap. One aim should be to avoid discontinuities in the temporal course of the resulting coefficients. This means, that no hard transition should be heard during moving a source between source position regions, in which different calculation methods (adapting a filter coefficient or using the filter coefficient calculated for the corresponding loudspeaker) are used.

The problems of existing wave-field synthesis algorithms mentioned may be treated by an algorithm (according to the described concept) which detects missing loudspeakers within an array (predefined loudspeaker arrangement) and whose signal portions are pre-distributed to existing loudspeakers (adapting the filter coefficients).

In this example, requirements to the algorithm are an automatic detection of gaps within the loudspeaker array. Further, the algorithm should be able to position a virtual source on each point without the appearance of audible amplitude jumps or delay jumps within the temporal course.

For this, the real, gap-comprising loudspeaker setup (predefined loudspeaker arrangement) may be converted to an ideal loudspeaker setup (different virtual loudspeaker arrangement) without gaps. Now, the wave-filed synthesis algorithm may calculate the coefficients on the basis of the ideal loudspeaker setup. Finally, these coefficients may be converted or adapted to coefficients for the real loudspeaker setup by the algorithm.

In this example, in a first stage, gaps within the loudspeaker array may be detected. The description of the loudspeaker array is equipped with additional loudspeakers for the wave-field synthesis algorithm, which fill the detected gaps completely or partly. A gap within the loudspeaker array may be assumed or detected by the algorithm every time a distance between two loudspeakers following each other exceeds a defined threshold. For example, the added loudspeakers may be positioned on a straight line, which is the direct connection between the loudspeakers enclosing the gap.

Figure 5:
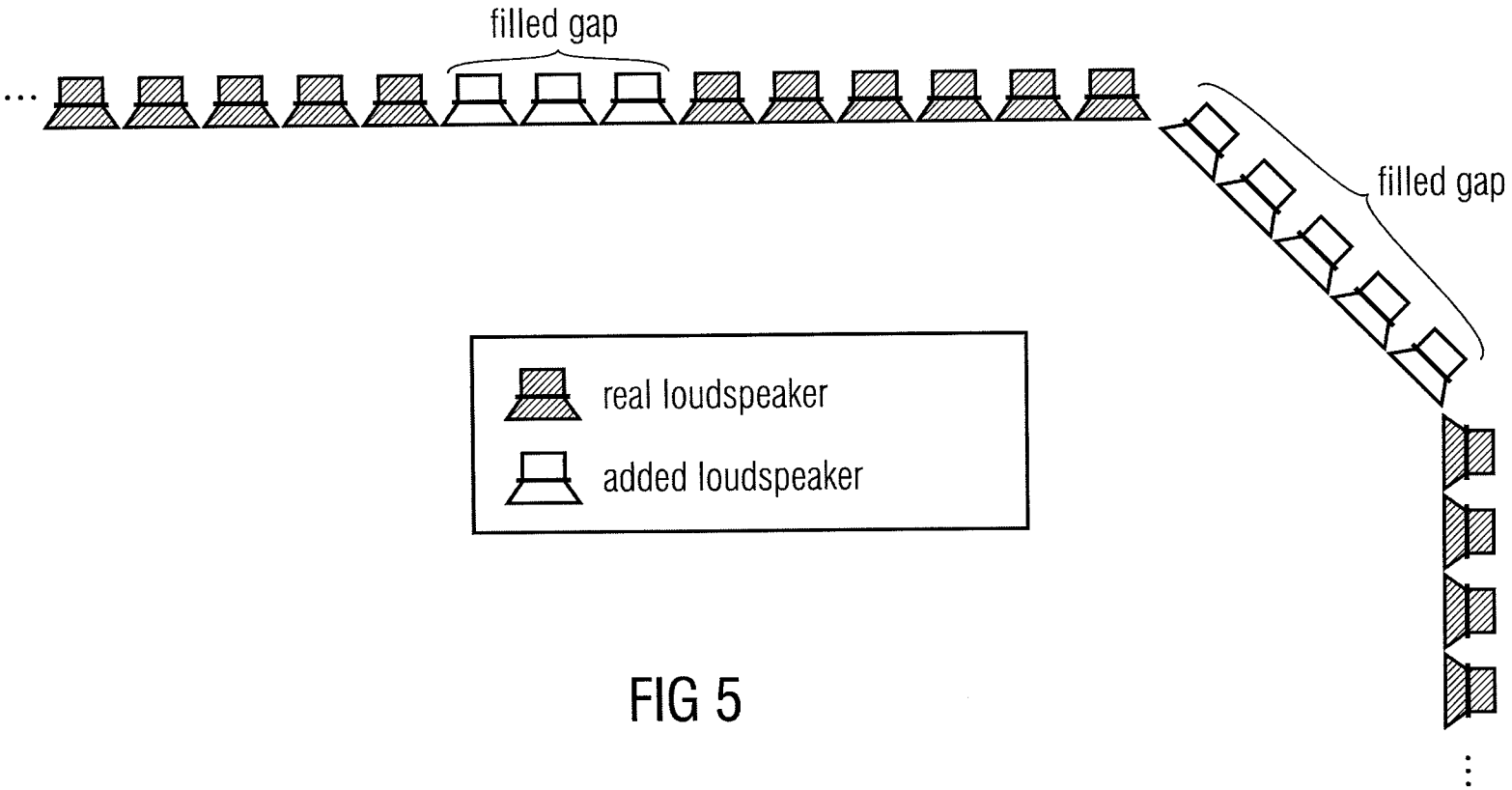
FIG. 5 is a schematic illustration of a predefined loudspeaker arrangement and of a different virtual loudspeaker arrangement with added loudspeakers.

An example for filling gaps of a loudspeaker arrangement is shown in FIG. 5. The real loudspeakers (dark colored) are part of the predefined loudspeaker arrangement and the determined virtual different loudspeaker arrangement comprises loudspeakers at the positions of the real loudspeakers (dark colored) and the added loudspeakers (white) filling the gaps of the predefined loudspeaker arrangement.

After filling the gaps, the wave-field synthesis algorithm may be used with the data of the ideal, gap-free loudspeaker array to calculate for each loudspeaker, including the added loudspeakers, a scaling value and a delay value.

In a second stage of the algorithm, the coefficients of the added loudspeakers may be distributed, for example, to both loudspeakers to the right and to the left of the gap (to the loudspeakers closest to the added loudspeakers). In this step, the coefficients may be distributed in a way, so that a smooth fading between the gap region and the wave-field synthesis region is possible. In the following, for this example, the manner of operation of the algorithm may be explained mathematically. The explanation may be based on FIG. 4*a* and its notation.

Based on the numbering of the loudspeakers from the left to the right, the loudspeakers $L_2$-$L_{n-1}$ may be the gap-loudspeakers added by the algorithm, which are not existing in the real loudspeaker arrangement (predefined loudspeaker arrangement). So, $L_1$ is the loudspeaker to the left of the resulting gap and $L_n$ is the loudspeaker to the right of the gap. Further, $A=\{a_1, \ldots, a_n\}$ may be the set of scaling coefficients and $\Delta=\{\delta_1, \ldots, \delta_n\}$ may be the set of delay coefficients for the loudspeakers $L=\{L_1, \ldots, L_n\}$.

For example, the algorithm uses two transformation functions which may calculate the resulting scaling values and delay values according to the following formulas:

$$A'=f_A(L,A,\Delta)$$

$$\Delta'=f_\Delta(L,A,\Delta)$$

In this embodiment, the coefficients $a'_k \in A'$ may be determined by the function $f_A(L, A, \Delta)$ according to the following formulas:

$$a'_k \begin{cases} \sum_{i=1}^{n} \frac{d(L_n, L_i)}{d(L_1, L_n)} a_i & \text{if } k = 1 \\ \sum_{i=1}^{n} \frac{d(L_1, L_i)}{d(L_1, L_n)} a_i & \text{if } k = n \\ \text{else} & \end{cases}$$

In this connection, $d(L_i, L_j)$ may be the distance of the loudspeakers $L_i$ and $L_j$ (see FIG. 4*a*). The amplitude coefficients of a virtual loudspeaker (added loudspeaker) are distributed to both loudspeakers $L_1$ and $L_n$ enclosing the gap. The closer a virtual loudspeaker is located to one of both real loudspeakers, the stronger its signal portion may be transferred to this real loudspeaker. This may enable a smooth transition between wave-field synthesis signals and signals of the gap-pannings. In this way, the requirement that no or nearly no amplitude jumps may appear may be fulfilled.

Alternatively or additionally, the signal portions of the added loudspeakers may be distributed to more real loudspeakers than only the both loudspeakers closest to the gap. The signal portions may be distributed considering the distance of a real loudspeaker (loudspeaker of the predefined loudspeaker arrangement) to the gap. The closer a real loudspeaker is to the gap, the stronger its filter coefficients may be adapted by signal portions of an added loudspeaker.

The resulting delay values $\delta'_1$ and $\delta'_n$ for the loudspeakers $L_1$ and $L_n$ may be set by the function $f_\Delta(L,A,\Delta)$ to the same value according to the following rule:

$$\delta'_1 = \delta'_n = \frac{\sum_{i=1}^{n} \delta_i a_i}{\sum_{i=1}^{n} a_i}$$

Figure 6:
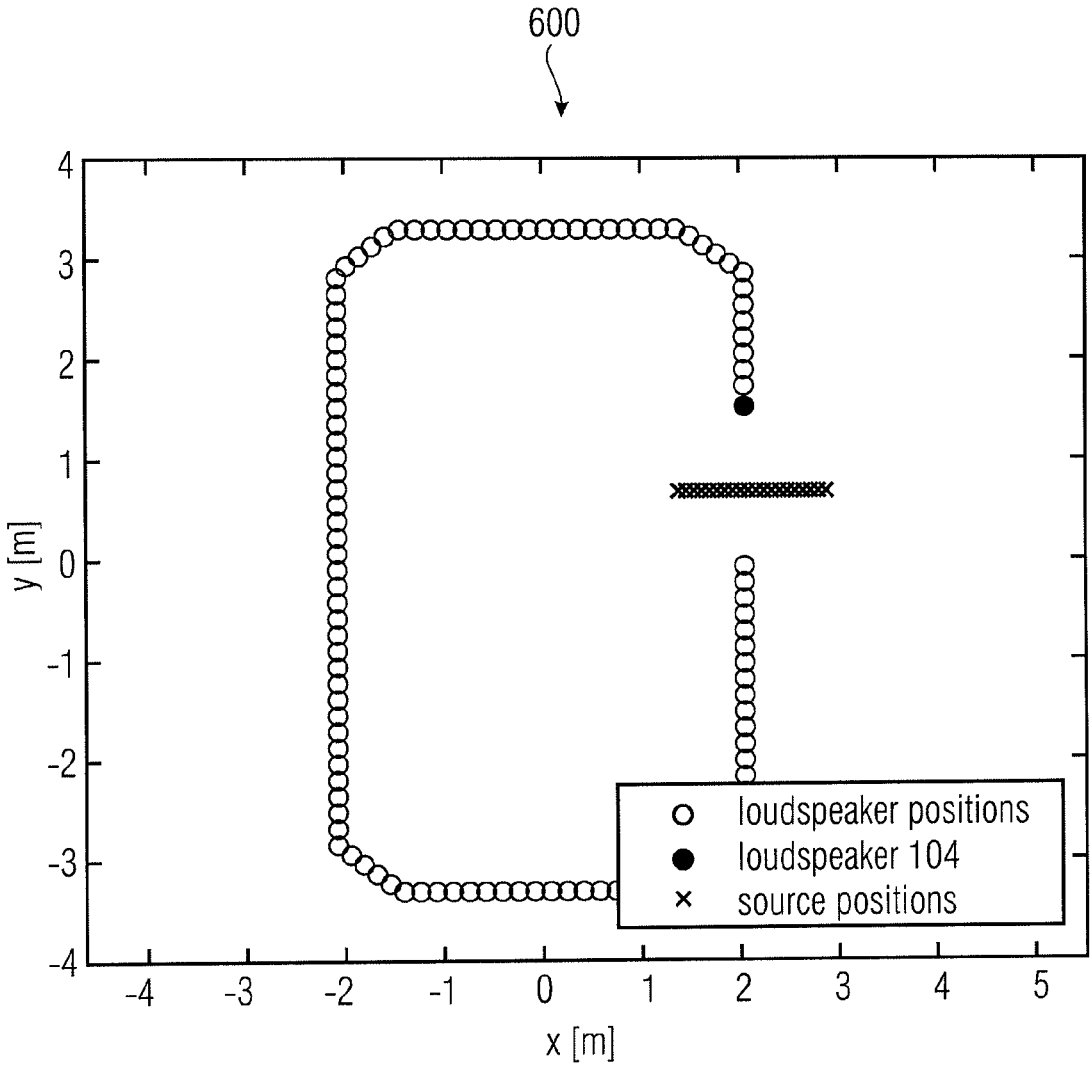
FIG. 6 is a schematic illustration of different source positions on a path crossing a gap in the predefined loudspeaker arrangement.
Figure 7:
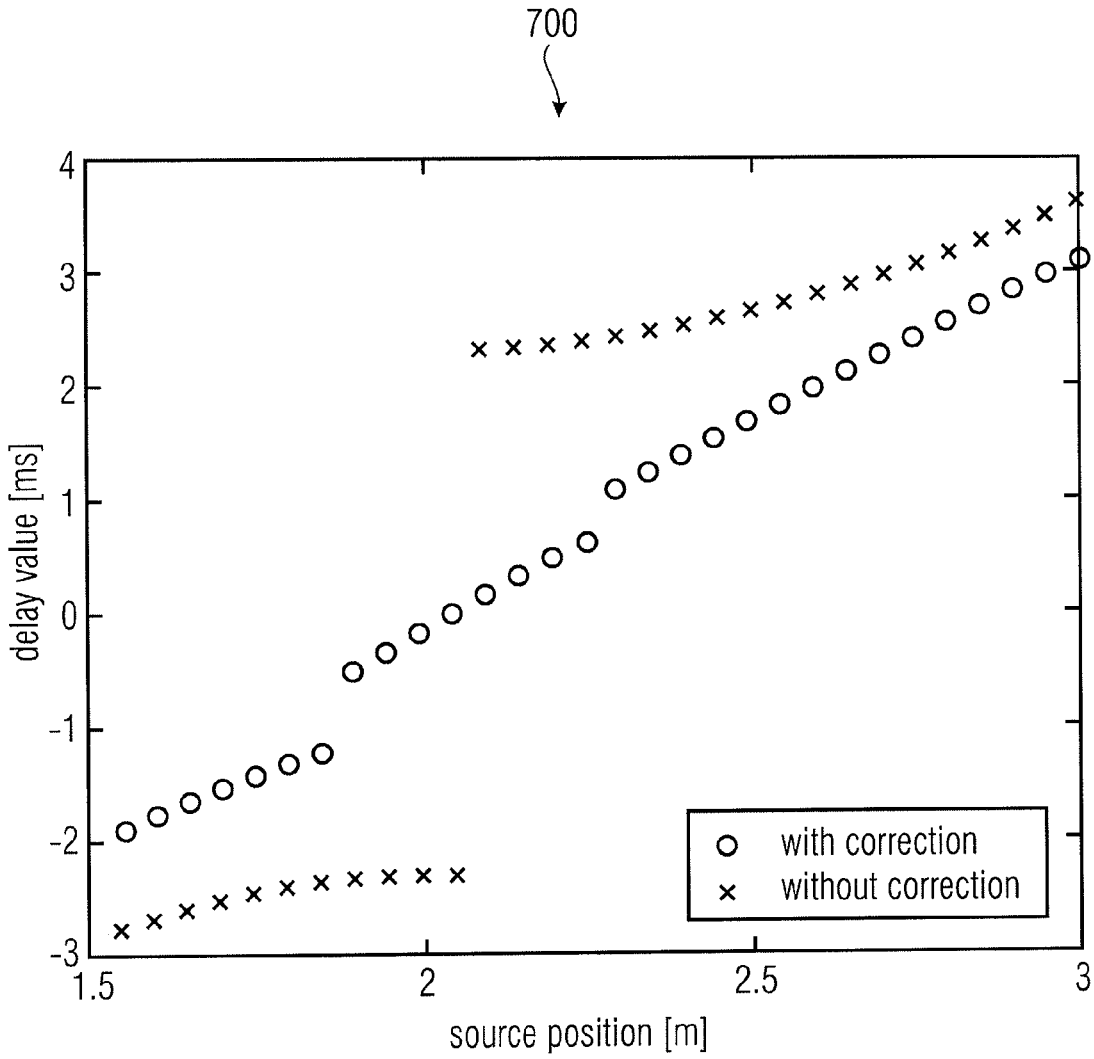
FIG. 7 is a schematic illustration of delay values of a loudspeaker neighboring the gap shown in FIG. 6 for different source positions.

According to the described algorithm, FIG. 6 shows an illustration 600 of different source positions on a path crossing the gap within the loudspeaker line. The loudspeaker positions representing the predefined loudspeaker arrangement are marked with an o and the source positions are marked with an x. A significant delay jump within the signal course of the loudspeaker 104 bordering the gap may be avoided, as shown in FIG. 7. FIG. 7 shows an illustration of the delay values 700 of loudspeaker 104 (indicated in FIG. 6) for the different source positions of FIG. 6.

The delay values calculated without correction (without adaptation of the filter coefficients according to the described concept) are marked with an x and the delay values calculated with correction (with adaptation of the filter coefficients according to the described concept) are marked with an o.

As a result, a smooth fading of the delay values is created, if the source is moved from loudspeaker $L_1$ to $L_n$. The requirement that no or nearly no jumps appear within the course of the delay values, if the source is arbitrarily moved, is therefore fulfilled.

In the example mentioned before, the arrangement determiner may determine the different virtual loudspeaker arrangement, so that at least one loudspeaker is added to the different virtual loudspeaker arrangement between two neighboring loudspeakers of the different virtual loudspeaker arrangement, if a distance between positions of the two neighboring loudspeakers is larger than a threshold distance, wherein the predefined loudspeaker arrangement comprises two neighboring loudspeakers corresponding to the two neighboring loudspeakers of the different virtual loudspeaker arrangement. In this connection, a neighboring loudspeaker is the closest loudspeaker regarding a specific direction. For example, in a line array, a loudspeaker (with exception of the first and the last loudspeaker of the line array) comprises a closest loudspeaker to the left and a closest loudspeaker to the right, which are the left and the right neighboring loudspeakers, although the distance to the right and the left loudspeaker may not be the same.

In a following step, the wave-field synthesis renderer may calculate an adapted filter coefficient for both neighboring loudspeakers of the predefined loudspeaker arrangement based on one or more filter coefficients calculated for one or more added loudspeakers of the different virtual loudspeaker arrangement. In other words, at least the loudspeaker of the predefined loudspeaker arrangement closest to a gap may be adapted based on the filter coefficients calculated for the added loudspeakers.

Figure 8:
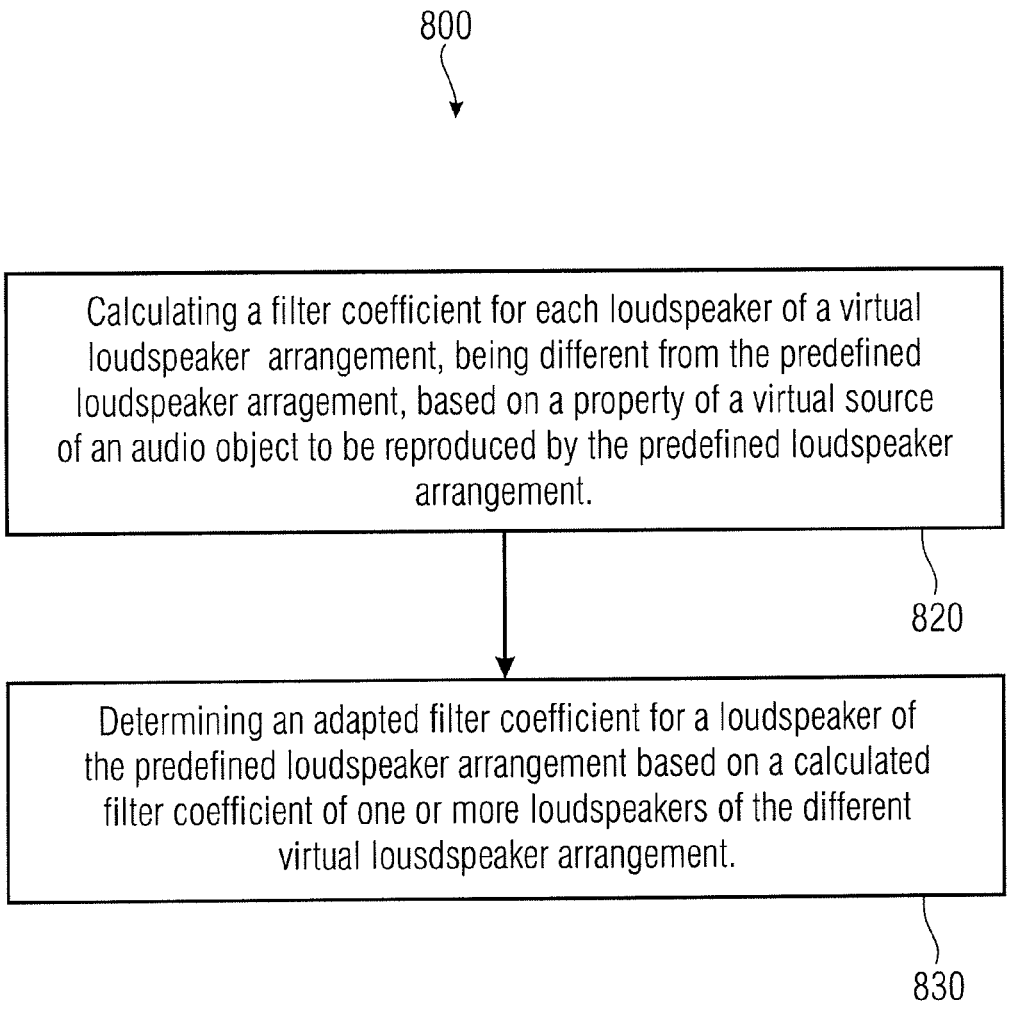
FIG. 8 is a flow chart of a method for calculating filter coefficients for a predefined loudspeaker arrangement.

FIG. 8 shows a flow chart of a method 800 for calculating filter coefficients for a predefined loudspeaker arrangement according to an embodiment of an invention. The predefined loudspeaker arrangement comprises a plurality of loudspeakers. The method 800 comprises calculating 820 a filter coefficient for each loudspeaker of a virtual loudspeaker arrangement, being different from the predefined loudspeaker arrangement, based on properties of the virtual source of an audio object to be reproduced by the predefined loudspeaker arrangement. Further, the method 800 comprises determining 830 an adapted filter coefficient for a loudspeaker of the predefined loudspeaker arrangement based on one or more calculated filter coefficients of one or more loudspeakers of the different virtual loudspeaker arrangement.

Figure 9:
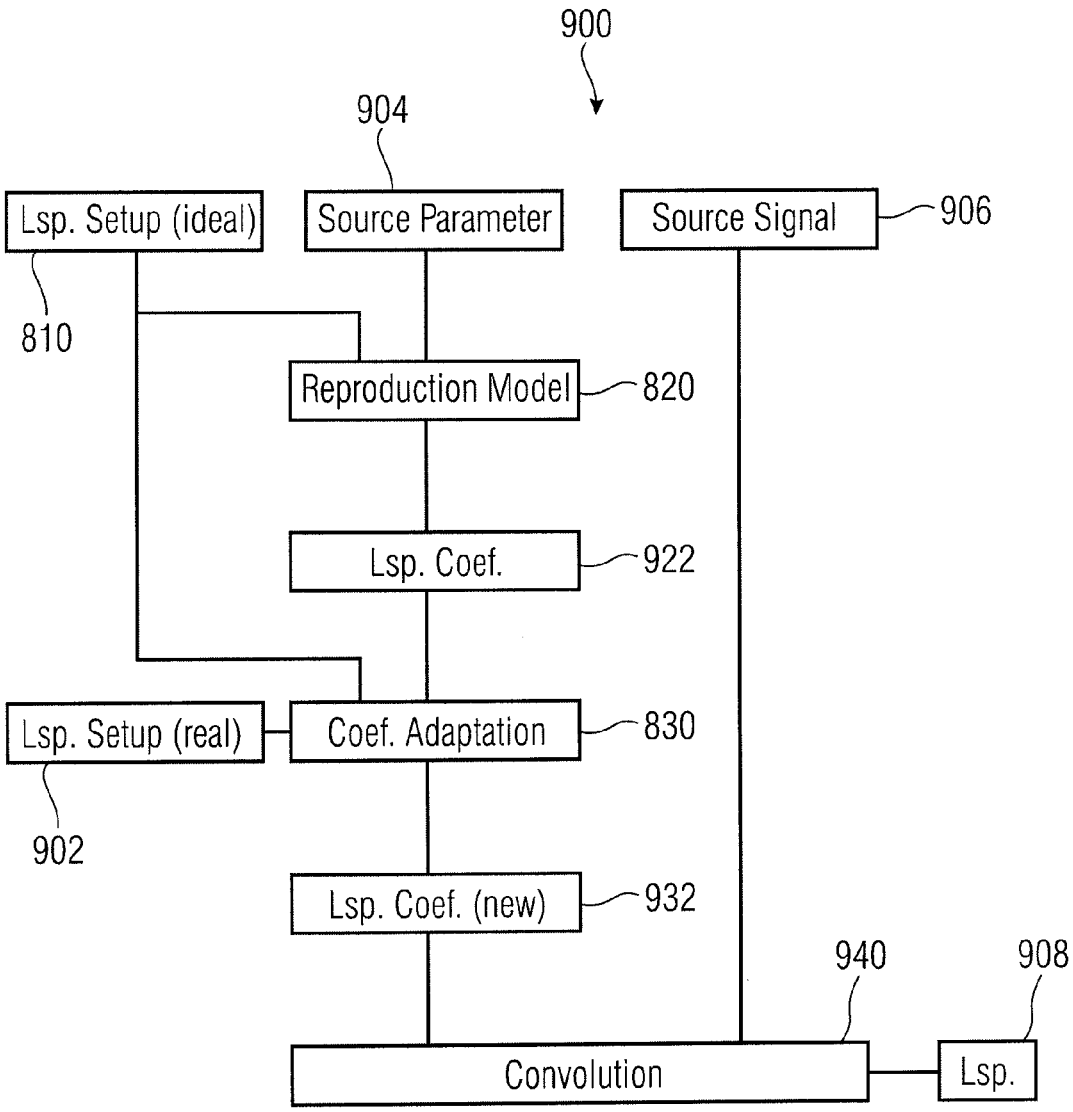
FIG. 9 is a flow chart of a method for calculating filter coefficients for a predefined loudspeaker arrangement.

FIG. 9 shows a flow chart of a method 900 for calculating filter coefficients for a predefined loudspeaker arrangement according to an embodiment of the invention. In this example, an ideal loudspeaker setup (different virtual loudspeaker arrangement) is determined 810. Based on a reproduction model, loudspeaker coefficients 922 (filter coefficients) are calculated 820 based on source parameters 904 (e.g. a virtual source position or a type of a virtual source of an audio object). Then, one or more filter coefficients of the loudspeakers of the different virtual loudspeaker arrangement are adapted 830 to determine new loudspeaker coefficients 932 (and adapted filter coefficients) for one or more loudspeakers of the real loudspeaker setup 902 (predefined loudspeaker arrangement). Further, the filter coefficients 932 of the loudspeakers of the predefined loudspeaker arrangement 902 may be convoluted 940, considering the corresponding source signals 906, to obtain an audio signal, which may be sent to the loudspeakers 908 of the predefined loudspeaker arrangement. The block diagram of FIG. 9 describes the steps for deriving the coefficients 932 for the real loudspeaker setup 902 from the coefficients 922 of an ideal loudspeaker setup.

Some embodiments according to the invention relate to an adaptation of filter coefficients for loudspeaker arrangements. If an ideal or optimal arrangement of the loudspeakers of a reproduction system exists, so this arrangement should be used also for the real loudspeaker arrangement, but this is often not possible. In this case, especially if an algorithm for calculating the loudspeaker signal cannot be found or can only be found with huge efforts for each real loudspeaker arrangement, it may be useful to derive the real arrangement from a simple calculable, fictitious arrangement.

The described concept maybe used in context with audio rendering routines which generate discrete signals for single loudspeakers based on a scene description. A scene description may consist of individual sources, which may be positioned in space. Each source may have one or more own audio data streams and parameters (as for example the position in space). Based on these parameters, a mapping of the source reproduction to a concrete loudspeaker setup may be done. During this mapping, information is created about how the loudspeaker signals can be derived from the audio signal of a source and its meta data. This information may be, for example, expressed in the form of finite impulse response (FIR) filter coefficients, which generate the particular loudspeaker signal by convolution with the audio signal of the source (see for example FIG. 9). Finally, a corresponding algorithm may be used for generating the audio signal of the loudspeaker from the coefficients and the given audio data stream of the source (convolution). One important aspect of the described matter is the transformation of the filter coefficients, which were calculated for an ideal loudspeaker setup, to filter coefficients of a real existing loudspeaker setup.

As a starting point for an algorithm calculating new filter coefficients for a given real loudspeaker setup, an ideal loudspeaker setup (determined based on the real loudspeaker setup), a source with corresponding meta data, and a set of filter coefficients for each loudspeaker of the ideal loudspeaker arrangement derived from them may exist. The calculation of the new filter coefficients may be done by an adaptation of the given loudspeaker coefficients of the ideal loudspeaker setup in the following way: the algorithm may analyze the differences between the ideal and the real arrangement and adapt the set of filter coefficients of the ideal setup correspondingly to generate a set of coefficients for the real setup.

According to the described concept, the reproduction parameters (filter coefficients) of a real loudspeaker arrangement (predefined loudspeaker arrangement) may be determined from an adaptation of the calculated parameters of an ideal arrangement (different virtual loudspeaker arrangement).

The described concept may use no final mixed loudspeaker signals as starting points, but separated information about source meta data and the associated audio data as well as the target arrangement of the loudspeakers. The coefficients for the mapping of the source data to the loudspeakers may not be calculated directly, but through an intermediate step in form of the calculation for a loudspeaker arrangement varying from the target arrangement.

In comparison to the described concept most known methods don't deal with the problem, that some geometric arrangements may only be calculated problematically, and therefore an easier way through the calculation of an ideal loudspeaker arrangement (according to the described concept) can be used. Further, in "Herre, J. and Faller, C. (2008). Apparatus and method for constructing a multi-channel output signal or for generating a downmix signal" parameters may be generated, which may be used for a mapping of audio signals to the target loudspeakers, but no coefficients are transformed to map a starting loudspeaker arrangement to a target loudspeaker arrangement. Also, in "Kuhn, C., Pellegrini, R., Rosenthal, M., and Corteel, E. (2008). Method and system for producing a binaural impression using loudspeakers" and "Strauss, M. and Hörnlein, T. (2008). Device and method for generating a number of loudspeaker signals for a loudspeaker array which defines a reproduction area" coefficients for real loudspeakers are not derived from the coefficients of virtual loudspeakers. In these documents the audio signals of the virtual loudspeakers are treated like new virtual audio sources.

Although some aspects of the described concept have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for calculating filter coefficients for a predefined loudspeaker arrangement, wherein the predefined loudspeaker arrangement comprises a plurality of loudspeakers, the apparatus comprising:

a multi-channel renderer configured to calculate a filter coefficient for each loudspeaker of a virtual loudspeaker arrangement, being different from the predefined loudspeaker arrangement, based on a property of a virtual source of an audio object to be reproduced by the predefined loudspeaker arrangement, and wherein the multi-channel renderer is configured to determine an adapted filter coefficient for a loudspeaker of the predefined loudspeaker arrangement based on one or more calculated filter coefficients of one or more loudspeakers of the different virtual loudspeaker arrangement, wherein the different virtual loudspeaker arrangement is determined, so that at least one loudspeaker is added to the different virtual loudspeaker arrangement between two neighboring loudspeakers of the different virtual loudspeaker arrangement, if a distance between positions of the two neighboring loudspeakers is larger than a threshold distance, wherein the predefined loudspeaker arrangement comprise two neighboring loudspeakers corresponding to the two neighboring loudspeakers of the different virtual loudspeaker arrangement.

2. The apparatus according to claim 1, comprising an arrangement determiner configured to determine the different virtual loudspeaker arrangement based on positions of the loudspeakers of the predefined loudspeaker arrangement.

3. The apparatus according to claim 1, wherein the multi-channel renderer is a wave-field synthesis renderer or a surround sound renderer.

4. The apparatus according to claim 1, wherein the determined different virtual loudspeaker arrangement represents an ideal loudspeaker arrangement, wherein an ideal loudspeaker arrangement comprises a higher geometric symmetry of positions of loudspeakers than a geometric symmetry of the positions of the loudspeakers of the predefined loudspeaker arrangement or comprises a more systematic distribution of the positions of the loudspeakers than a distribution of the positions of the loudspeakers of the predefined loudspeaker arrangement.

5. The apparatus according to claim 1, wherein the multi-channel renderer is configured to determine an adapted filter coefficient for a loudspeaker of the predefined loudspeaker arrangement, if the loudspeaker of the predefined loudspeaker arrangement comprises an associated loudspeaker within the different virtual loudspeaker arrangement, wherein the associated loudspeaker of the different virtual loudspeaker arrangement comprises a different position in comparison to a position of the loudspeaker of the predefined loudspeaker arrangement, or if the loudspeaker of the predefined loudspeaker arrangement comprises a position closer to a position of an added loudspeaker of the different virtual loudspeaker arrangement than any other loudspeaker of the predefined loudspeaker arrangement, wherein the added loudspeaker of the different virtual loudspeaker arrangement comprises no corresponding and no associated loudspeaker within the predefined loudspeaker arrangement, or if the loudspeaker of the predefined loudspeaker arrangement comprises no corresponding and no associated loudspeaker within the different virtual loudspeaker arrangement.

6. The apparatus according to claim 5, wherein the multi-channel renderer is configured to determine the adapted filter coefficient for the loudspeaker of the predefined loudspeaker arrangement, if the loudspeaker of the predefined loudspeaker arrangement comprises an associated loudspeaker of the different virtual loudspeaker arrangement, based on the filter coefficient calculated for the associated loudspeaker of the different virtual loudspeaker arrangement and based on a position difference between a position of the loudspeaker of the predefined loudspeaker arrangement and a position of the associated loudspeaker of the different virtual loudspeaker arrangement, or wherein the multi-channel renderer is configured to determine an adapted filter coefficient for the loudspeaker of the predefined loudspeaker arrangement, if the loudspeaker of the predefined loudspeaker arrangement comprises a closest position to a position of the added loudspeaker of the different virtual loudspeaker arrangement of all loudspeakers of the predefined loudspeaker arrangement, based on a filter coefficient calculated for the added loudspeaker of the different virtual loudspeaker arrangement and based on a position difference between a position of the loudspeaker of the predefined loudspeaker arrangement and a position of the added loudspeaker of the different virtual loudspeaker arrangement, or wherein the multi-channel renderer is configured to determine the adapted filter coefficient for the loudspeaker of the predefined loudspeaker arrangement, if the loudspeaker of the predefined loudspeaker arrangement comprises no corresponding and no associated loudspeaker within the different virtual loudspeaker arrangement, based on a filter coefficient calculated for a loudspeaker of the different virtual loudspeaker arrangement comprising a closest position to a position of the loudspeaker of the predefined loudspeaker arrangement of all loudspeakers of the different virtual loudspeaker arrangement and based on a position difference between a position of the loudspeaker of the predefined loudspeaker arrangement and a position of the closest loudspeaker of the different virtual loudspeaker arrangement.

7. The apparatus according to claim 1, wherein the multi-channel renderer is configured to assign a filter coefficient calculated for a loudspeaker of the different virtual loudspeaker arrangement to a corresponding loudspeaker of the predefined loudspeaker arrangement, so that the filter coefficient of at least one loudspeaker of the predefined loudspeaker arrangement is equal to the calculated filter coefficient of the corresponding loudspeaker of the different virtual loudspeaker arrangement.

8. The apparatus according to claim 1, wherein the multi-channel renderer is configured to calculate an adapted filter coefficient for at least both neighboring loudspeakers of the predefined loudspeaker arrangement based on a filter coefficient calculated for the added loudspeaker of the different virtual loudspeaker arrangement.

9. The apparatus according to claim 1, wherein the multi-channel renderer is configured to determine an adapted filter coefficient for both neighboring loudspeakers of the predefined loudspeaker arrangement, wherein the filter coefficient is a scaling parameter determined according to:

$$a'_k \begin{cases} \sum_{i=1}^{n} \frac{d(L_n, L_i)}{d(L_1, L_n)} a_i & \text{if } k = 1 \\ \sum_{i=1}^{n} \frac{d(L_1, L_i)}{d(L_1, L_n)} a_i & \text{if } k = n \\ \text{else} & \end{cases}$$

wherein $a_k$ is an adapted scaling parameter, $a_i$ is a scaling parameter of loudspeaker $L_i$, i indicates the loudspeaker number, $L_i$ is the i-th loudspeaker, $L_1$ and $L_n$ are the two loudspeakers neighbouring the added loudspeakers $L_2$ to $L_{n-1}$, n is the number of loudspeakers and $d(L_i, L_j)$ is the distance between loudspeaker $L_i$ and $L_j$.

10. The apparatus according to claim 1, wherein the multi-channel renderer is configured to determine an adapted filter coefficient for both neighboring loudspeakers of the predefined loudspeaker arrangement, wherein the filter coefficient is a delay parameter determined according to:

$$\delta'_1 = \delta'_n = \frac{\sum_{i=1}^{n} \delta_i a_i}{\sum_{i=1}^{n} a_i}$$

wherein $a_i$ is a scaling parameter of loudspeaker $L_i$, $\delta_i$ is a delay parameter of loudspeaker $L_i$, i is the number of a loudspeaker, n is the number of loudspeakers, $\delta'_1$ is the adapted delay parameter of the first neighboring loudspeaker and $\delta'_n$ is the adapted delay parameter of the second neighboring loudspeaker.

11. The apparatus according to claim 1, wherein the multi-channel renderer is configured to calculate at least one filter coefficient for each loudspeaker of the different virtual loudspeaker arrangement based on properties of a virtual source of an audio object for each audio object of a plurality of audio objects to be reproduced by the predefined loudspeaker arrangement.

12. The apparatus according to claim 1, wherein the multi-channel renderer is configured to determine an adapted filter coefficient for loudspeakers of the predefined loudspeaker arrangement comprising corresponding loudspeakers within the different virtual loudspeaker arrangement, so that an adapted filter coefficient determined for a loudspeaker of the predefined loudspeaker arrangement comprising a first distance to a loudspeaker comprising no corresponding loudspeaker differs more from a filter coefficient of its corresponding loudspeaker than an adapted filter coefficient determined for a loudspeaker of the predefined loudspeaker arrangement comprising a second distance to the loudspeaker comprising no corresponding loudspeaker, wherein the second distance is larger than the first distance.

13. The apparatus according to claim 1, wherein the property of the virtual source is a virtual source position or a type of the virtual source.

14. A method for calculating filter coefficients for a predefined loudspeaker arrangement, wherein the predefined loudspeaker arrangement comprises a plurality of loudspeakers, the method comprising:

calculating a filter coefficient for each loudspeaker of a virtual loudspeaker arrangement, being different from the predefined loudspeaker arrangement, based on a property of a virtual source of an audio object to be reproduced by the predefined loudspeaker arrangement; and determining an adapted filter coefficient for a loudspeaker of the predefined loudspeaker arrangement based on one or more calculated filter coefficients of one or more loudspeakers of the different virtual loudspeaker arrangement, wherein the calculating or the determining are performed by a multi-channel renderer, and wherein the multi-channel renderer comprises a hardware implementation, wherein the different virtual loudspeaker arrangement is determined, so that at least one loudspeaker is added to the different virtual loudspeaker arrangement between two neighboring loudspeakers of the different virtual loudspeaker arrangement, if a distance between positions of the two neighboring loudspeakers is larger than a threshold distance, wherein the predefined loudspeaker arrangement comprise two neighboring loudspeakers corresponding to the two neighboring loudspeakers of the different virtual loudspeaker arrangement.

15. A non-transitory storage medium having stored thereon a computer program with a program code for performing when the computer program runs on a computer or a microcontroller, a method for calculating filter coefficients for a predefined loudspeaker arrangement, wherein the predefined loudspeaker arrangement comprises a plurality of loudspeakers, the method comprising: calculating a filter coefficient for each loudspeaker of a virtual loudspeaker arrangement, being different from the predefined loudspeaker arrangement, based on a property of a virtual source of an audio object to be reproduced by the predefined loudspeaker arrangement; and determining an adapted filter coefficient for a loudspeaker of the predefined loudspeaker arrangement based on one or more calculated filter coefficients of one or more loudspeakers of the different virtual loudspeaker arrangement, wherein the different virtual loudspeaker arrangement is determined, so that at least one loudspeaker is added to the different virtual loudspeaker arrangement between two neighboring loudspeakers of the different virtual loudspeaker arrangement, if a distance between positions of the two neighboring loudspeakers is larger than a threshold distance, wherein the predefined loudspeaker arrangement comprise two neighboring loudspeakers corresponding to the two neighboring loudspeakers of the different virtual loudspeaker arrangement.

16. An apparatus for calculating filter coefficients for a predefined loudspeaker arrangement, wherein the predefined loudspeaker arrangement comprises a plurality of loudspeakers, the apparatus comprising:

a multi-channel renderer configured to calculate a filter coefficient for each loudspeaker of a virtual loudspeaker arrangement, being different from the predefined loudspeaker arrangement, based on a property of a virtual source of an audio object to be reproduced by the predefined loudspeaker arrangement, and wherein the multi-channel renderer is configured to determine an adapted filter coefficient for a loudspeaker of the predefined loudspeaker arrangement based on one or more calculated filter coefficients of one or more loudspeakers of the different virtual loudspeaker arrangement, wherein the multi-channel renderer is configured to determine an adapted filter coefficient for loudspeakers of the predefined loudspeaker arrangement comprising corresponding loudspeakers within the different virtual loudspeaker arrangement, so that an adapted filter coefficient determined for a loudspeaker of the predefined loudspeaker arrangement comprising a first distance to a loudspeaker comprising no corresponding loudspeaker differs more from a filter coefficient of its corresponding loudspeaker than an adapted filter coefficient determined for a loudspeaker of the predefined loudspeaker arrangement comprising a second distance to the loudspeaker comprising no corresponding loudspeaker, wherein the second distance is larger than the first distance.

17. A method for calculating filter coefficients for a predefined loudspeaker arrangement, wherein the predefined loudspeaker arrangement comprises a plurality of loudspeakers, the method comprising:

calculating a filter coefficient for each loudspeaker of a virtual loudspeaker arrangement, being different from the predefined loudspeaker arrangement, based on a property of a virtual source of an audio object to be reproduced by the predefined loudspeaker arrangement; and determining an adapted filter coefficient for a loudspeaker of the predefined loudspeaker arrangement based on one or more calculated filter coefficients of one or more loudspeakers of the different virtual loudspeaker arrangement, wherein the calculating or the determining are performed by a multi-channel renderer, and wherein the multi-channel renderer comprises a hardware implementation, wherein an adapted filter coefficient for loudspeakers of the predefined loudspeaker arrangement comprising corresponding loudspeakers within the different virtual loudspeaker arrangement is determined, so that an adapted filter coefficient determined for a loudspeaker of the predefined loudspeaker arrangement comprising a first distance to a loudspeaker comprising no corresponding loudspeaker differs more from a filter coefficient of its corresponding loudspeaker than an adapted filter coefficient determined for a loudspeaker of the predefined loudspeaker arrangement comprising a second distance to the loudspeaker comprising no corresponding loudspeaker, wherein the second distance is larger than the first distance.

18. A non-transitory storage medium having stored thereon a computer program with a program code for performing when the computer program runs on a computer or a microcontroller, a method for calculating filter coefficients for a predefined loudspeaker arrangement, wherein the predefined loudspeaker arrangement comprises a plurality of loudspeakers, the method comprising: calculating a filter coefficient for each loudspeaker of a virtual loudspeaker arrangement, being different from the predefined loudspeaker arrangement, based on a property of a virtual source of an audio object to be reproduced by the predefined loudspeaker arrangement; and determining an adapted filter coefficient for a loudspeaker of the predefined loudspeaker arrangement based on one or more calculated filter coefficients of one or more loudspeakers of the different virtual loudspeaker arrangement, wherein an adapted filter coefficient for loudspeakers of the predefined loudspeaker arrangement comprising corresponding loudspeakers within the different virtual loudspeaker arrangement is determined, so that an adapted filter coefficient determined for a loudspeaker of the predefined loudspeaker arrangement comprising a first distance to a loudspeaker comprising no corresponding loudspeaker differs more from a filter coefficient of its corresponding loudspeaker than an adapted filter coefficient determined for a loudspeaker of the predefined loudspeaker arrangement comprising a second distance to the loudspeaker comprising no corresponding loudspeaker, wherein the second distance is larger than the first distance.

* * * * *